US005436958A

United States Patent [19]

Taylor

[11] Patent Number: 5,436,958

[45] Date of Patent: Jul. 25, 1995

[54] ADJUSTABLE COLLIMATOR

[75] Inventor: Daniel R. S. Taylor, Hartland, Wis.

[73] Assignee: General Electric Company, Milwaukee, Wis.

[21] Appl. No.: 285,251

[22] Filed: Aug. 3, 1994

[51] Int. Cl.[6] ..... G21K 5/10

[52] U.S. Cl. ..... 378/149; 378/147; 378/148; 378/150

[58] Field of Search ..... 378/147–151; 250/505.1

[56] References Cited

U.S. PATENT DOCUMENTS 3,191,557 6/1965 Moore .
3,890,506 6/1975 Berninger ..... 250/213 VT
3,919,556 11/1975 Berninger ..... 250/363
4,288,697 9/1981 Albert ..... 378/149
4,419,585 12/1983 Strauss et al. ..... 378/149
4,582,994 4/1986 Berg ..... 250/363
5,293,417 3/1994 Wei et al. ..... 378/147
5,303,282 4/1994 Kwasnick et al. ..... 378/147

*Primary Examiner*—David P. Porta
*Assistant Examiner*—Don Wong
*Attorney, Agent, or Firm*—Quarles & Brady

[57] ABSTRACT

A collimator for a gamma camera is formed by a stack of lamina formed from tungsten. Each lamina has an array of openings formed through it, and a movable support member translates the lamina into different alignments of these openings to form corresponding different hole patterns through the collimator.

6 Claims, 1 Drawing Sheet

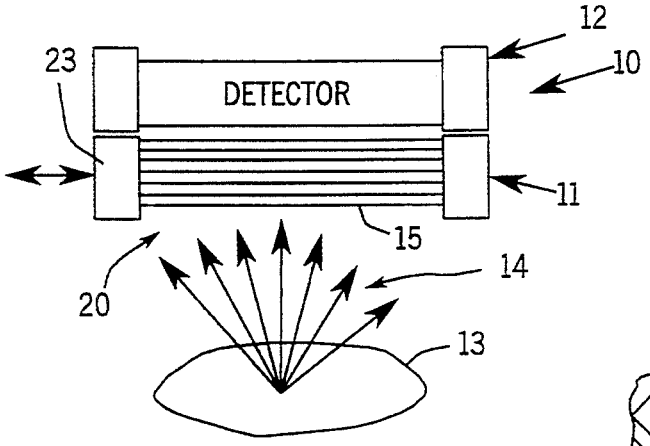
FIG. 1
FIG. 2
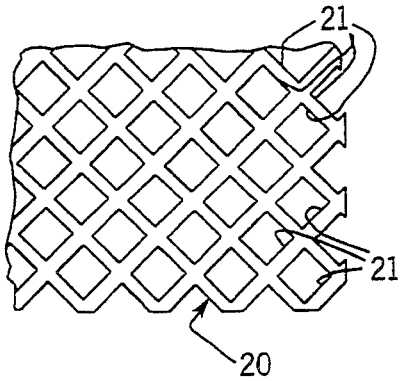
FIG. 3A
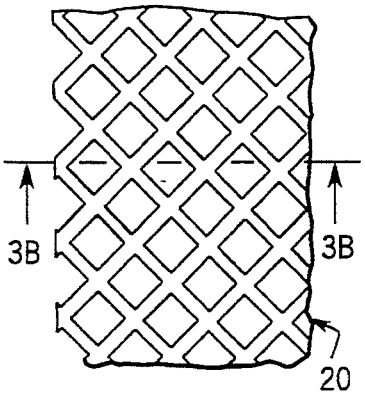
FIG. 3B
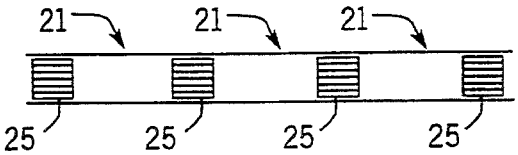
FIG. 4A
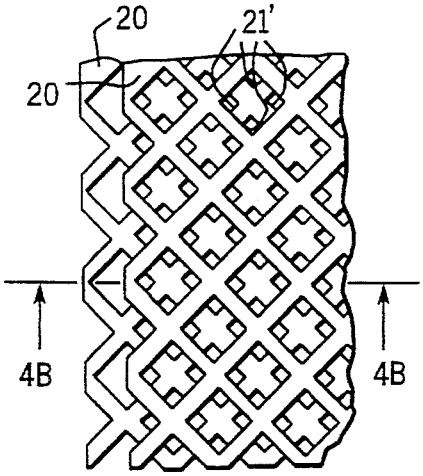
FIG. 4B
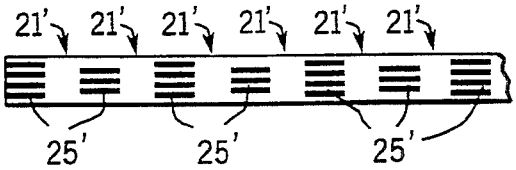
FIG. 5
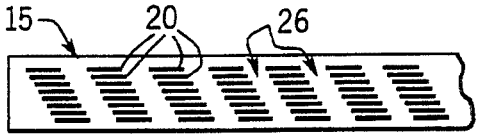

ADJUSTABLE COLLIMATOR

BACKGROUND OF THE INVENTION

The field of the invention is collimators for use with detectors of radiation in medical imaging equipment, and particularly, collimators for gamma cameras.

Collimators are used to form images of a gamma ray emitting source on gamma ray detector elements mounted in a gamma camera. Collimators are positioned between the detectors and the source of the gamma radiation, and may comprise, for example, a slab of lead through which an array of holes is formed. In the alternative, a honeycomb structure formed from interlocked pieces of gamma ray attenuating material are also commonly used. Ideally, gamma rays emanating directly from the source and incident normal to the face of the detector array pass through the collimator, while all other gamma rays are absorbed by the attenuating material. Such gamma cameras are described, for example, in U.S. Pat. Nos. 3,890,506; 3,919,556; 3,191,557 and 4,582,994 which are assigned to the assignee of the present invention.

The performance of a collimator is measured by a number of factors including: the spatial resolution of the resulting image; the ability to block gamma rays at various energy levels; and the sensitivity, or geometric efficiency of the structure. These characteristics are determined by the attenuation coefficient of the collimator material, the size of the holes, the thickness of the walls, or "septa", separating the holes and the length of the holes.

In nuclear medicine, isotopes emitting gamma rays of differing energy are employed to study various organs of the human body. For higher energy gamma rays the geometry of the collimator is different than that of a collimator made from the same material for use at lower energy levels since more material (i.e. lead in the above example) is needed to block high energy gamma rays. As a result, in a typical installation several collimators are required to deal with the expected range of gamma ray energies produced by commonly used isotopes and to maintain the desired sensitivity and resolution.

Changing the collimator is a time consuming process. In addition to the blocking material, a surrounding steel or aluminum collar for mounting the collimator to the gamma camera adds to its weight and size. The resulting mass is typically 20 to 40 kg and requires about 30 minutes of machine down time to change and balance.

SUMMARY OF THE INVENTION

The present invention is a collimator formed as a plurality of lamina, each lamina constructed from a gamma ray attenuating material and having an array of openings formed therethrough, and an adjustment mechanism for moving selected ones of the lamina with respect to other ones of the lamina to align their openings such that a plurality of geometrically different hole patterns may be formed through the collimator. By adjusting the relative positions of the lamina the geometry of the holes formed by their aligned openings can be changed to alter the collimator performance factors. Thus, the blocking ability, resolution and sensitivity of the collimator can be changed by simply adjusting relative lamina positions.

A general object of the invention is to provide a single collimator which can be adjusted to operate at different energy levels. The lamina can be adjusted such that they maximize the gamma ray blocking characteristic of the collimator and optimize its performance at high gamma ray energy levels. On the other hand, when operated at lower energy levels the lamina may be adjusted to reduce the size of the holes and thereby increase image resolution.

Another object of the invention is to provide a collimator in which the angle of incident gamma rays allowed to pass through to the detector array can be adjusted. When the opening patterns in the lamina are the same and the lamina are perfectly aligned, the resulting holes pass through the collimator normal to the collimator front surface. However, the individual lamina can be shifted with respect to each other to tilt the holes in any direction over a wide range of angles and thereby control the directional behavior of the collimator.

BRIEF DESCRIPTION OF THE DRAWINGS

FIG. 1 is a schematic diagram of a gamma camera which employs the preferred embodiment of the invention;

FIG. 2 is a partial plan view of one of the lamina employed in the collimator of the gamma, camera of FIG. 1;

FIG. 3A is a partial plan view of lamina in the collimator aligned for use at high energy levels;

FIG. 3B is a partial view in cross section of the lamina in FIG. 3A;

FIG. 4A is a partial plan view of lamina in the collimator aligned for use at low energy levels;

FIG. 4B is a partial view in cross section of the lamina in FIG. 4A; and

FIG. 5 is a partial view in cross section of the lamina in an alternative embodiment of the invention showing the separate adjustment of each lamina position to tilt the holes in the collimator.

DESCRIPTION OF THE PREFERRED EMBODIMENT

Referring particularly to FIG. 1, a gamma camera 10 includes a collimator 11 and a detector 12. The collimator 11 is disposed between the detector 12 and a source of gamma rays such as a patient 13. The patient 13 is typically injected with a gamma ray emitting isotope that is taken up by a particular type of tissue or organ to be imaged. As indicated by arrows 14, the gamma rays are emitted in all directions from any single point in the patient 13, and it is the function of the collimator 11 to block all the rays 14 except those traveling in a specific direction. In the preferred embodiment, rays 14 normal to the front surface 15 of the collimator 11 are passed through to the detector 12, and all others are blocked, or attenuated. As a result, the detector 12 will produce signals that are processed to form a two-dimensional image of the gamma rays emanating from points in the patient 13.

The medical isotopes in common use emit gamma rays over a wide range of energy levels. Low energy gamma rays (i.e. less than $\approx$150 keV) are emitted for example by thallium isotopes used to image the heart, medium energy gamma rays (i.e. 150 to 300 keV) are emitted by technetium for whole body imaging, and high energy gamma rays (i.e. over 300 keV) are emitted by iodine for imaging the thyroid. In prior systems, a different collimator 11 was provided for each of these three energy ranges. At decreasing gamma ray energy levels less attenuating material (lead, tungsten, or an alloy based on lead/tungsten) is required to block the gamma rays from the detector 12, and this enables the use of a higher resolution hole pattern in the collimator 11 with smaller inter-hole spacing.

Referring particularly to FIGS. 1 and 2, the collimator 11 of the present invention is comprised of a stack of lamina 20. Each lamina 20 is formed from a sheet of attenuating material such as tungsten, and it has an array of openings 21 formed therein. In the preferred embodiment the openings 21 are square and are sized to provide the best resolution and sensitivity possible at the high and medium gamma ray energy levels. Alternate ones of the lamina 20 in the stack are connected to a stationary support member 22 and the remaining lamina 20 in the stack are connected to a movable support member 23. The interdigitated lamina 20 may be aligned in a high energy mode in which the openings 21 in the stationary and movable lamina 20 are aligned as shown in FIGS. 3A land 3B. In this mode, the septa 25 formed by the aligned lamina 20 provide maximum blocking to the high energy gamma rays and the holes in the collimator 11 are the full shape and size of the lamina openings 21.

The collimator 11 may also be configured to operate at higher resolution when lower gamma ray energies are employed. Referring particularly to FIGS. 4A and 4B, in this mode the movable lamina 20 are translated by a distance equal to one-half the pitch of the openings 21. The resulting misalignment of alternate lamina 20 creates a larger number of smaller holes 21' through the collimator 11 to provide increased resolution. However, as shown in FIG. 4B, the blocking ability of the resulting septa 25' is significantly reduced by this misalignment.

The preferred embodiment of the collimator 11 is designed for use at gamma ray energies ranging from 200 keV to 450 keV. Each tungsten lamina 20 has a 0.05 mm lubricating layer attached to its upper surface to facilitate the mechanical sliding action of each lamina 20 over its neighbors. The lubricating layer may be formed of a fluorocarbon polymer such as that sold under the trademark "Teflon". The tungsten part of each lamina 20 has a thickness of 0.45 mm and the square openings are 5.6 mm on each side. The square openings are separated by 1.5 mm. A total of 100 lamina 20 are employed in the stack and they are in physical contact with each other to provide a total hole length in the high energy configuration of 50 mm. When the lamina 20 are aligned in their high energy mode, the preferred embodiment may be employed with x-ray energy levels of from 350 to 450 keV. When the lamina 20 are misaligned in their low energy mode, the preferred embodiment may be employed with x-ray energy levels of from 200 to 300 keV.

The collimator holes in the preferred embodiment are normal to the front surface 15 of the collimator 11 in both its high and lower energy configurations. An alternative embodiment of the invention is shown in FIG. 5 in which hole angle may be changed to accommodate a variety of applications. In this embodiment each lamina 20 is separately translated to "slant" the holes 26 at the desired angle. If translational motion of each lamina 20 is controlled along both its dimensions, not only the angle of the holes 26 can be controlled, but also the direction of the slant with respect to the front surface 15 can be controlled.

Those skilled in the art can appreciate that many variations are possible from the preferred embodiments described above without departing from the spirit of the invention. For example, the shape and size of the openings in each lamina 20 may be different (e.g. circular, hexagonal etc.) and the movable lamina 20 may be misaligned in different amounts than that described above (e.g. one-eighth the opening pitch rather than one-half). Also, the lamina 20 may be formed by separately movable strips of attenuating material which enable the control of both hole size and septa thickness in its different configurations.

I claim:

1. A collimator for blocking all but selected gamma rays produced by a source from reaching a detector, which comprises:

a plurality of lamina positioned one on top of the other to form a stack, the stack of lamina is positioned between said source and said detector each lamina being formed from a gamma ray attenuating material and each having an array of openings formed therethrough; and means for translating lamina in the stack to align the array of openings therein in a plurality of configurations to form a corresponding plurality of different hole patterns that extend through the stack of lamina in which alternate ones of the lamina in the stack are supported by a stationary member and the other ones of the lamina in the stack are aligned to form said plurality of configurations by the means for translating;

wherein the different hole patterns formed in the stack of lamina provide different gamma ray blocking characteristics.

2. The collimator as recited in claim 1 in which the array of openings are substantially the same in each lamina.

3. The collimator as recited in claim 2 in which each opening has a square shape.

4. The collimator as recited in claim 1 in which the holes each extend through the stack of lamina in a direction substantially normal to a front surface of the stack of lamina facing said source.

5. The collimator as recited in claim 1 in which the holes formed by each configuration extend through the stack of lamina in a different direction with respect to a front surface of the stack of lamina facing said source.

6. The collimator as recited in claim 1 in which each lamina includes a lubricating layer which facilitates translating the lamina between its plurality of configurations.

* * * * *